US009698461B2

(12) United States Patent
Nagai

(10) Patent No.: US 9,698,461 B2
(45) Date of Patent: Jul. 4, 2017

(54) RESONANT COUPLER

(71) Applicant: Panasonic Intellectual Property Management Co., Ltd., Osaka (JP)

(72) Inventor: Shuichi Nagai, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 36 days.

(21) Appl. No.: 14/784,405

(22) PCT Filed: Apr. 3, 2014

(86) PCT No.: PCT/JP2014/001931
§ 371 (c)(1),
(2) Date: Oct. 14, 2015

(87) PCT Pub. No.: WO2014/171091
PCT Pub. Date: Oct. 23, 2014

(65) Prior Publication Data

US 2016/0226122 A1 Aug. 4, 2016

(30) Foreign Application Priority Data

Apr. 18, 2013 (JP) ..... 2013-087837

(51) Int. Cl.
*H01P 5/02* (2006.01)
*H01F 27/28* (2006.01)
*H01P 7/08* (2006.01)

(52) U.S. Cl.
CPC ..... *H01P 5/028* (2013.01); *H01F 27/2804* (2013.01)

(58) Field of Classification Search
CPC ..... H01P 5/028; H01P 7/082
(Continued)

(56) References Cited

U.S. PATENT DOCUMENTS 7,397,331 B2 7/2008 Koizumi et al.
7,466,214 B2 * 12/2008 Kanno ..... H01P 7/082 333/219

(Continued)

FOREIGN PATENT DOCUMENTS

CN 100466374 3/2009
JP 2009188713 A * 8/2009

(Continued)

OTHER PUBLICATIONS

International Search Report issued Jul. 1, 2014 in corresponding International Application No. PCT/JP2014/001931 (with English translation).

(Continued)

*Primary Examiner* — Dean Takaoka
(74) *Attorney, Agent, or Firm* — Wenderoth, Lind & Ponack, L.L.P.

(57) ABSTRACT

A resonant coupler includes, on the main surface of a first dielectric substrate: a first resonant line disposed in a circumferential shape and having proximate first and second ends; an input line into which a signal is inputted; and a first connecting line that grounds a first end of the first resonant line, and, similar to the first dielectric substrate, includes, on the main surface of a second dielectric substrate: a second resonant line; an output line; and a second connecting line. When viewed in a direction perpendicular to the main surface of the first dielectric substrate, the first resonant line and the second resonant line have substantially matching contours, and the first resonant line and the second resonant line have a combined shape that is symmetrical about a line.

16 Claims, 9 Drawing Sheets

(58) Field of Classification Search
USPC ..... 333/24 R, 219, 219.1, 202, 204
See application file for complete search history.

(56) References Cited

U.S. PATENT DOCUMENTS

| | | | | |
|---|---|---|---|---|
| 7,592,884 | B2 * | 9/2009 | Matters-Kammerer | H01P 1/20345 333/185 |
| 7,692,444 | B2 | 4/2010 | Chen et al. | |
| 8,552,821 | B2 | 10/2013 | Nagai | |
| 8,729,983 | B2 | 5/2014 | Nagai | |
| 2006/0193559 | A1 | 8/2006 | Koizumi et al. | |
| 2013/0147580 | A1 * | 6/2013 | Nagai ..... | H01P 1/2013 333/204 |
| 2013/0187477 | A1 | 7/2013 | Nagai et al. | |
| 2014/0002212 | A1 | 1/2014 | Nagai | |
| 2014/0049345 | A1 | 2/2014 | Nagai | |
| 2014/0218136 | A1 | 8/2014 | Nagai | |

FOREIGN PATENT DOCUMENTS

| | | |
|---|---|---|
| JP | 2009-246810 | 10/2009 |
| JP | 4915747 | 10/2009 |
| WO | 2012/153529 | 11/2012 |
| WO | 2012/153531 | 11/2012 |
| WO | 2013/065238 | 5/2013 |

OTHER PUBLICATIONS

S. Nagai et al., "A DC-isolated gate drive IC with drive-by-microwave technology for power switching devices," 2012 IEEE International Solid-State Circuits Conference Digest of Technical Papers (ISSCC), IEEE, Feb. 22, 2012, pp. 404-406.

André Kurs et al., "Wireless Power Transfer via Strongly Coupled Magnetic Resonances," Science, Jul. 6, 2007, vol. 317, No. 5834, pp. 83-86.

Search Report issued Sep. 18, 2016 in corresponding Chinese Application No. 201480021354.2 (with English translation).

* cited by examiner

RESONANT COUPLER

TECHNICAL FIELD

The present invention relates to resonant couplers used for wireless signal transmission or wireless energy transmission.

BACKGROUND ART

Wireless transmission technology is a known technology for transmitting signals or energy between electrical devices not directly connected by lines.

The electronic circuit element known as a digital isolator is one example of a wireless transmission apparatus which uses wireless transmission technology (for example, see Patent Literature (PTL) 1). The technology disclosed in PTL 1 can isolate the ground for logic signals from the ground for RF signals, and as such, is widely applicable.

This kind of wireless transmission apparatus is used as a gate driving element for, for example, an insulated gate bipolar transistor (IGBT), which is a power electronics semiconductor switching device. With this kind of power semiconductor switching device, due to fluctuation in source potential with reference to high voltage, it is necessary to insulate the DC component between within the gate driving element and the power semiconductor switching device.

Moreover, electromagnetic resonant couplers (also known as electromagnetic field resonant couplers) which employ the coupling of two electrical line resonators are one example of wireless transmission technology that has gained attention in recent years (for example, see Non-Patent Literature (NPTL) 1). These electromagnetic resonant couplers are characterized by an ability to efficiently transmit signals across a great distance.

Among these electromagnetic resonant couplers, although the structure is simplistic, an open ring type electromagnetic resonant coupler can be realized that is compact and capable of accomplishing wireless transmission in a small space (for example, see PTL 2).

CITATION LIST

Patent Literature

[PTL 1] U.S. Pat. No. 7,692,444
[PTL 2] Japanese Pat. No. 4,915,747
[PTL 3] WO 2013/065238

Non Patent Literature

[NPL 1] Andre Kurs, et al.: "Wireless Power Transfer via Strongly Coupled Magnetic Resonances", Science Express, Vol. 317, No. 5834, pp. 83-86 (2007)

Summary of Invention

Technical Problem

When an electromagnetic resonant coupler is used as the above-described gate driving element, the size of the wireless transmission apparatus is substantially large. In other words, realizing a compact, highly integrated wireless transmission apparatus is difficult.

The present invention has an object to provide an electromagnetic resonant coupler which allows for realization of a compact, highly integrated wireless transmission apparatus.

Solution to Problem

According to one aspect of the present invention, an electromagnetic resonant coupler wirelessly transmits a signal between a first resonant line and a second resonant line and includes a first substrate and a second substrate across from the first substrate. The first substrate includes, on a main surface: the first resonant line disposed in a circumferential shape and having a first end and a second end; an input line, into which the signal is inputted, connected to the first resonant line; and a first grounding part that grounds the first end of the first resonant line. The second substrate includes, on a main surface: the second resonant line disposed in a circumferential shape and having a first end and a second end; an output line, from which the signal is outputted, connected to the second resonant line; and a second grounding part that grounds the first end of the second resonant line. When viewed in a direction perpendicular to the main surface of the first substrate, the first resonant line and the second resonant line have substantially matching contours, and the first resonant line and the second resonant line have a combined shape that is symmetrical about a line.

Advantageous Effects of Invention

The resonant coupler according to the present invention can be manufactured to be smaller than a conventional resonant coupler having the same operating frequency, and the wireless transmission apparatus used in the resonant coupler can be made to be compact and highly integrated.

DESCRIPTION OF EMBODIMENTS (Underlying Knowledge Forming Basis of the Present Invention)

As disclosed in the Background Art section, electromagnetic resonant couplers are one example of wireless transmission technology.

These electromagnetic resonant couplers are used as wireless transmission apparatuses as gate driving elements for power semiconductor switching devices, as described above. For example, these electromagnetic resonant couplers are used in inverter systems or matrix converter systems used achieve AC power of a given frequency from DC power.

Among these electromagnetic resonant couplers, although the structure is simplistic, an open ring type electromagnetic resonant coupler can be realized that is compact and capable of accomplishing wireless transmission in a small space, such as the resonant coupler disclosed in PTL 2.

Figure 1:
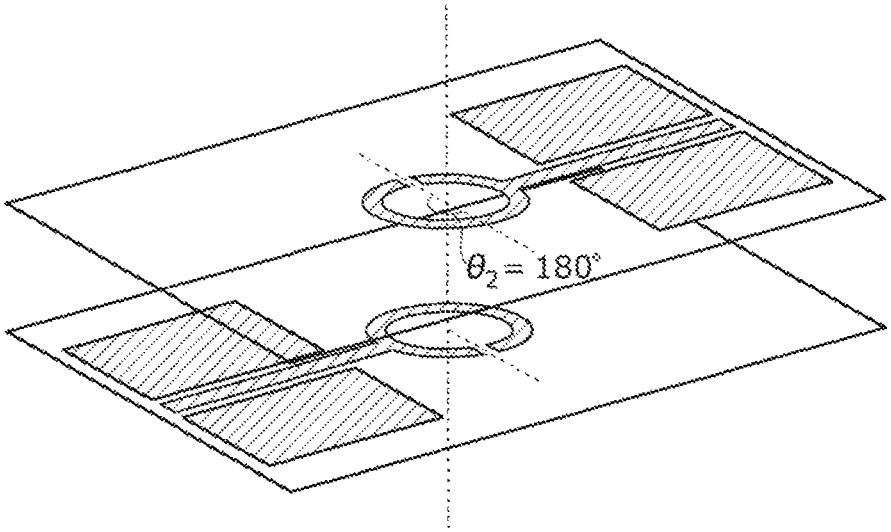
FIG. 1 is a schematic diagram of the conventional electromagnetic resonant coupler disclosed in PTL 2.

FIG. 1 is a schematic diagram of the electromagnetic resonant coupler disclosed in PTL 2.

The frequency (operating frequency) of the signal capable of being transmitted by an open ring type electromagnetic resonant coupler such as the one shown in FIG. 1 is, to be exact, determined by the inductance and capacitance of the ring shaped resonant line in the electromagnetic resonant coupler. However, the operating frequency can be approximately calculated from the effective area of the ring shaped line and the dielectric constant of the substrate on which the ring shaped line is formed.

[Math. 1]

$$fr = \frac{1}{2\pi\sqrt{LC}} \approx \frac{c}{2\pi a\sqrt{\varepsilon_r}} \quad \text{(Equation 1)}$$

In Equation 1, c is the speed of light and $\in_r$ is the relative dielectric constant of the substrate (dielectric material). Moreover, a is the effective area of the ring shaped line, which is approximately the diameter of the ring.

For example, when signal of a frequency around 15 GHz is to be transmitted in the open ring type electromagnetic resonant coupler, the diameter of the ring shaped line is made to be approximately 1 mm.

In other words, compared to transistors and such in semiconductor integrated circuits, the open ring type electromagnetic resonant coupler is substantially large in size.

Here, with Equation 1, increasing the operating frequency makes it possible to decrease the size of the electromagnetic resonant coupler. Generally, however, the higher the operating frequency, the more indeterminate parasitic capacitance or parasitic inductance affects the transmitted signal. This is problematic since it makes stable operation of the electromagnetic resonant coupler difficult, whereby circuitry costs increase in order to realize stable operation.

Here, when an electromagnetic resonant coupler is used as a gate driving element in an inverter system or the like described in the Background Art section, since a wireless transmission apparatus provided with a plurality of electromagnetic resonant couplers is required, achieving a compact and highly integrated wireless transmission apparatus is problematic.

Here, to reduce space occupied by the electromagnetic resonator, an electromagnetic resonant coupler has been proposed that transmits a plurality of signals with a single electromagnetic resonant coupler (for example, see PTL 3).

However, such an electromagnetic resonant coupler that transmits a plurality of signals with a single electromagnetic resonant coupler has a design constraint that a ground must be shared for two signals to be transmitted.

Moreover, such an electromagnetic resonant coupler that transmits a plurality of signals with a single electromagnetic resonant coupler also has design constraints concerning the ground line (shunt line) for separately transmitting two signals. For example, when the line width of the shunt line is thin, two signals cannot be properly separated, degrading the transmission characteristics. Moreover, when the line width of the shunt line is thick, the space occupied by the shunt line increases, thereby increasing the probability of interference with the electromagnetic resonant coupler main body and degrading transmission characteristics.

In other words, electromagnetic resonant couplers that transmit a plurality of signals with a single electromagnetic resonant coupler are problematic because they have are many design constraints.

According to one aspect of the present invention, a resonant coupler wirelessly transmits a signal between a first resonant line and a second resonant line and includes a first substrate and a second substrate across from the first substrate. The first substrate includes, on a main surface: the first resonant line disposed in a circumferential shape and having a first end and a second end; an input line, into which the signal is inputted, connected to the first resonant line; and a first grounding part that grounds the first end of the first resonant line. The second substrate includes, on a main surface: the second resonant line disposed in a circumferential shape and having a first end and a second end; an output line, from which the signal is outputted, connected to the second resonant line; and a second grounding part that grounds the first end of the second resonant line. When viewed in a direction perpendicular to the main surface of the first substrate, the first resonant line and the second resonant line have substantially matching contours, and the first resonant line and the second resonant line have a combined shape that is symmetrical about a line.

With this, since the line length of the first resonant line can be made to be one-fourth of the wavelength of the signal to be transmitted, the resonant coupler can be manufactured to be smaller than a conventional resonant coupler having the same operating frequency. Moreover, with such a resonant coupler, since only one signal is to be transmitted, there are less design constraints than with electromagnetic resonant couplers that transmit a plurality of signals since the structure is simpler.

Moreover, the first substrate may further include, on the main surface, a first ground line peripheral to the first resonant line, the first grounding part may be a line that grounds the first end of the first resonant line by connecting the first end of the first resonant line to the first ground line, the second substrate may further include, on the main surface, a second ground line peripheral to the second resonant line, and the second grounding part may be a line that grounds the first end of the second resonant line by connecting the first end of the second resonant line to the second ground line.

Moreover, the first ground line may be disposed along the first resonant line at a predetermined distance from the first resonant line, and surround the first resonant line, and the second ground line may be disposed along the second resonant line at a predetermined distance from the second resonant line, and surround the second resonant line.

With this, the transmission characteristics of the resonant coupler can be improved and the operating frequency of the resonant coupler can be substantially decreased. In other words, a further compact resonant coupler can be realized.

The first ground line may include, in a portion that surrounds the first resonant line, a first ground gap that opens a portion of the first ground line, and the second ground line may include, in a portion that surrounds the second resonant line, a second ground gap that opens a portion of the second ground line.

With this, the operating frequency of the resonant coupler can be substantially decreased. In other words, a further compact resonant coupler can be realized.

Moreover, in the portion of the first ground line that surrounds the first resonant line, the first ground gap may be located across from a region in which the first end of the first resonant line and the second end of the first resonant line are proximately located, the first ground gap may span a predetermined length that is less than or equal to four line widths of the first ground line, in the portion of the second ground line that surrounds the second resonant line, the second ground gap may be located across from a region in which the first end of the second resonant line and the second end of the second resonant line are proximately located, and the second ground gap may span a predetermined length that is less than or equal to four line widths of the second ground line.

With this, the operating frequency of the resonant coupler can be substantially decreased. In other words, a further compact resonant coupler can be realized.

Moreover, the first substrate may further include a first auxiliary line disposed outside of the contour of the first resonant line and having a first end connected to the second end of the first resonant line, the first auxiliary line may have a second end positioned less than or equal to four line widths of the first auxiliary line from the first ground line, the second substrate may further include a second auxiliary line disposed outside the contour of the second resonant line and having a first end connected to the second end of the second resonant line, and the second auxiliary line may have a second end positioned less than or equal to four line widths of the second auxiliary line from the second ground line.

The first grounding part may be a via hole that grounds the first end of the first resonant line, and the second grounding part may be a via hole that grounds the first end of the second resonant line.

Moreover, the resonant coupler may further include a third substrate disposed on top of the main surface of the second substrate. The main surface of the first substrate and a surface of the second substrate opposite the main surface of the second substrate may be in contact, the first substrate may include, on a surface opposite the main surface, a rear ground line, the third substrate may include, on a surface opposite a surface contacting the second substrate, a third ground line, the first grounding part may be a via hole that grounds the first end of the first resonant line by connecting the first end of the first resonant line to the rear ground line, and the second grounding part may be a via hole that grounds the first end of the second resonant line by connecting the first end of the second resonant line to the third ground line.

With this, undesired radiation from the resonant coupler can be inhibited and the transmission characteristics of the resonant coupler can be improved.

Moreover, the circumferential shape may include a loop shape, a coil shape, and a bracket shape.

Moreover, the first end of the first resonant line and the second end of the first resonant line may be proximately located, giving the first resonant line a loop shape, and the first end of the second resonant line and the second end of the second resonant line may be proximately located, giving the second resonant line a loop shape.

Moreover, the first resonant line and the second resonant line may have rectangular contours.

Moreover, the first substrate may further include, on the main surface: a first opening that opens a portion of the first resonant line; and a first meander line that is disposed within the contour of the first resonant line when viewed in a direction perpendicular to the main surface of the first substrate, and connects two ends of the first resonant line forming the first opening. The second substrate may further include, on the main surface: a second opening that opens a portion of the second resonant line; and a second meander line that is disposed within the contour of the second resonant line when viewed in a direction perpendicular to the main surface of the second substrate, and connects two ends of the second resonant line forming the second opening. When viewed in a direction perpendicular to the main surface of the first substrate, a shape of the first resonant line and the first meander line and a shape of the second resonant line and the second meander line may have a combined shape that is symmetrical about a line.

With this, the line length of the resonant line (the first resonant line) can be extended by the line length of the first meander line (the second meander line). In other words, the operating frequency can be reduced even when extending line length by maintaining the same area of occupation, and an even more compact resonant coupler can be realized.

Moreover, the first meander line may include: a first line disposed in a straight line shape and having a first end connected to a first of the two ends forming the first opening; a second line disposed in a straight line shape and having a first end connected to a second of the two ends forming the first opening; and a third line disposed in a straight line shape and having a first end connected to a second end of the first line and a second end connected to a second end of the second line. The second meander line may include: a fourth line disposed in a straight line shape and having a first end connected to a first of the two ends forming the second opening; a fifth line disposed in a straight line shape and having a first end connected to a second of the two ends forming the second opening; and a sixth line disposed in a straight line shape and having a first end connected to a second end of the fourth line and a second end connected to a second end of the fifth line.

In this way, disposing the lines more densely increases the self-capacitance component and the inductance component of the resonant line (the first resonant line and the second first meander line), making it possible to further reduce the operating frequency.

Moreover, the first substrate may include, on the main surface, a region in which the first resonant line and the first meander line are proximately located, separated by less than or equal to four line widths of the first resonant line or less than or equal to four line widths of the first meander line, and the second substrate may include, on the main surface, a region in which the second resonant line and the second meander line are proximately located, separated by less than or equal to four line widths of the second resonant line or less than or equal to four line widths of the second meander line.

Moreover, the first substrate and the second substrate may be integrated as a single substrate, the main surface of the first substrate may be a main surface of the single substrate, and the main surface of the second substrate may be a surface of the single substrate opposite the main surface of the single substrate.

Moreover, the first end of the first resonant line and the second end of the first resonant line may be proximately located, separated by a predetermined distance less than or equal to four line widths of the first resonant line, and the first end of the second resonant line and the second end of the second resonant line may be proximately located, separated by a predetermined distance less than or equal to four line widths of the second resonant line.

With this, the operating frequency of the resonant coupler can be substantially decreased. In other words, a further compact resonant coupler can be realized.

Moreover, the first resonant line may have a line length corresponding to a quarter wavelength of the signal in the first resonant line, and the second resonant line may have a line length corresponding to a quarter wavelength of the signal in the second resonant line.

Moreover, the first resonant line and the second resonant line may be separated in a direction perpendicular to the main surface of the first substrate by a distance within a half wavelength of the signal in the first resonant line.

With this, the resonant coupler can more strongly perform electromagnetic resonant coupling, and the transmission characteristics of the resonant coupler can be improved.

Moreover, the first resonant line and the second resonant line may have circular contours.

Hereinafter, embodiments of the present invention will be described with reference to the Drawings. Note that each figure is a schematic and is not necessarily an exact depiction.

Note that each of the embodiments described below shows a preferred example. The numerical values, shapes, materials, elements, the arrangement and connection of the elements, steps, the processing order of the steps etc. shown in the following embodiments are mere examples, and therefore do not limit the scope of the present invention. Therefore, among the elements in the following embodiments, elements not recited in any one of the independent claims are described as arbitrary elements.

Embodiment 1

Hereinafter, Embodiment 1 of the present invention will be described with reference to the Drawings.

(Structure)

First, the structure of the resonant coupler according to Embodiment 1 will be described.

Figure 2:
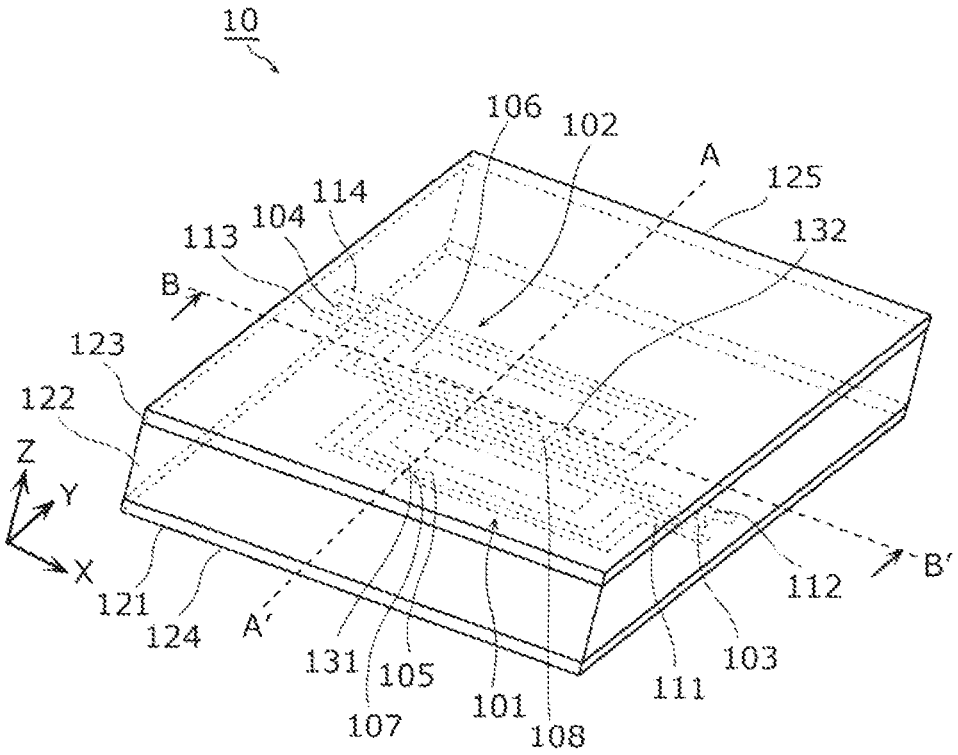
FIG. 2 is a perspective view of the resonant coupler according to Embodiment 1.

FIG. 2 is a perspective view of the resonant coupler according to Embodiment 1.

Figure 3:
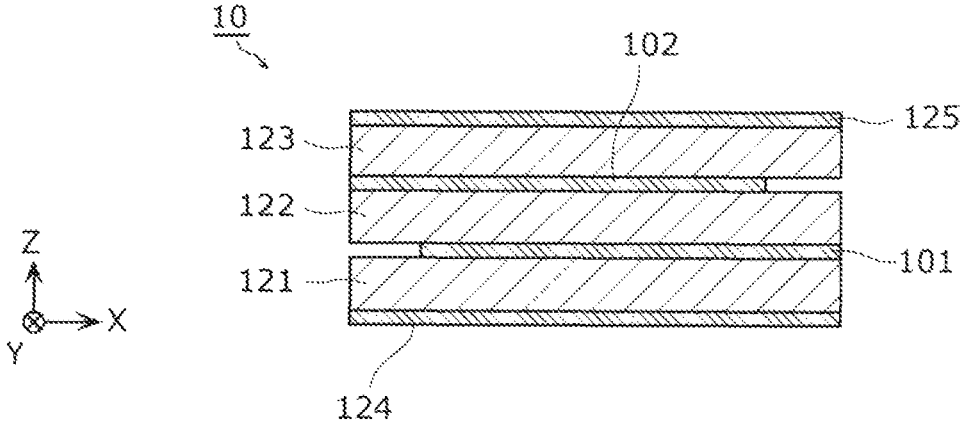
FIG. 3 is a cross section of the resonant coupler illustrated in FIG. 2 in a plane perpendicular to the main surface of the substrate and passing through line B-B' illustrated in FIG. 3.

FIG. 3 is a cross section of the resonant coupler illustrated in FIG. 2 in a plane perpendicular to the main surface of the substrate and passing through line B-B' illustrated in FIG. 3. Note that in FIG. 2 and FIG. 3, a direction parallel to one side of the substrate is defined as the X axis direction, a direction parallel to a perpendicular side is defined as the Y axis direction, and a direction in which the substrates are layered is defined as the Z axis direction.

The resonant coupler 10 according to Embodiment 1 is a resonant coupler which transmits 5 GHz AC signals.

As illustrated in FIG. 2 and FIG. 3, the resonant coupler 10 includes a first dielectric substrate 121 (the first substrate), a second dielectric substrate 122 (the second substrate), and a third dielectric substrate 123 (the third substrate).

The first dielectric substrate 121 and the second dielectric substrate 122 are disposed across from one another. More specifically, as illustrated in FIG. 2 and FIG. 3, the rear surface (the surface opposite the main surface) of the second dielectric substrate 122 is disposed on top of the front surface (the main surface) of the first dielectric substrate 121.

The second dielectric substrate 122 and the third dielectric substrate 123 are disposed across from one another. More specifically, as illustrated in FIG. 2 and FIG. 3, the rear surface (the surface opposite the main surface) of the third dielectric substrate 123 is disposed on top of the front surface (the main surface) of the second dielectric substrate 122.

In Embodiment 1, the first dielectric substrate 121, the second dielectric substrate 122, and the third dielectric substrate 123 are sapphire substrates, but may be substrates made of other materials such as silicon semiconductors. Moreover, in Embodiment 1, the first dielectric substrate 121, the second dielectric substrate 122, and the third dielectric substrate 123 are rectangular substrates, but may be circular substrates or substrates having any other shape.

Note that in the following description, the front surface of each substrate is referred to as the first main surface, and the rear surface of each substrate is referred to as the second main surface.

As illustrated in FIG. 2 and FIG. 3, a first resonator 101 is disposed on the first main surface of the first dielectric substrate 121. Moreover, a second resonator 102 is disposed on the first main surface of the second dielectric substrate 122.

The first resonator 101 includes an input line 103, a first resonant line 105, a first connecting line 107, first ground lines 111 and 112, and a first gap 131.

The second resonator 102 includes an output line 104, a second resonant line 106, a second connecting line 108, second ground lines 113 and 114, and a second gap 132.

Moreover, a rear ground line 124 is disposed on the entire rear surface of the first dielectric substrate 121. Similarly, a cap ground line 125 (the third ground line) is disposed on the entire front surface of the third dielectric substrate 123.

In Embodiment 1, the first resonator 101, the second resonator 102, the rear ground line 124, and the third dielectric substrate 123 are made of gold, but may be made of a different metallic conductor.

Next, with reference to FIG. 4A through FIG. 4C, the shapes, etc., of the first resonator 101 and the second resonator 102 will be described in more detail.

First, the first resonator 101 will be described with reference to FIG. 4A. FIG. 4A illustrates the structure of the first resonator 101.

Figure 4A:
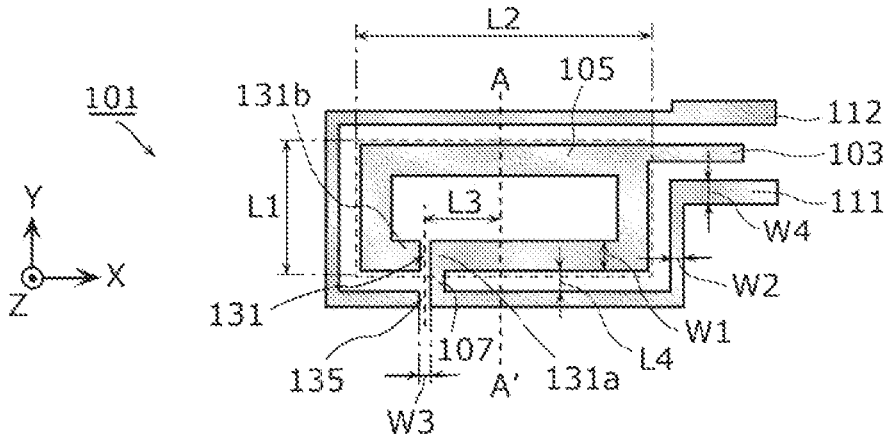
FIG. 4A illustrates the structure of the first resonator.

As illustrated in FIG. 4A, the first resonant line 105 is a line in a closed loop shape that has one portion opened by the first gap 131. In other words, the first resonant line 105 has a first end 131*a* and a second end 131*b* which are proximately located so as to be separated by a predetermined distance (width W3), thereby giving the first resonant line 105 a loop shape. Moreover, the first end 131*a* of the first resonant line 105 and the second end 131*b* of the first resonant line 105 form the first gap 131.

Note that a loop shape refers to the closed shape resulting from removing the first gap 131, and includes a shape having a meandering portion. A loop shape is, for example, a ring shape or a racetrack shape. Here, the first resonant line 105 may have a loop shape with a polygonal contour, and may have a loop shape with an elliptical contour. Moreover, the first resonant line 105 may have what is known as a racetrack shape, and may have a loop shape include a meandering portion. Moreover, here "proximate" means disposed nearby, and does not include a state of contact (disposed so as to be contiguous).

The first resonant line 105 has a constant line width W1, but the line width W1 is not required to be constant.

In Embodiment 1, the first resonant line 105 is formed in a loop having a rectangular (quadrilateral) contour. More specifically, the first resonant line 105 is formed in a rectangular loop having a contour whose width L1 in the vertical (Y axis) direction is smaller than the width L2 in the horizontal (X axis) direction. Here, the contour of the first resonant line 105 is defined as follows.

Supposing that the first resonant line 105 is a line having a closed loop shape that does not include the first gap 131, this closed loop-shaped line includes an inner circumference contour (inner contour) defining an area surrounded by the closed loop-shaped line, and an outer circumference contour (outer contour) defining the shape of the closed loop-shaped line including the inner circumference contour. Here, the contour of the first resonant line 105 refers to the outer contour of the first resonant line 105 among these two contours. In other words, the quadrilateral shape indicated by the dashed line in FIG. 4A is the contour of the first resonant line 105. In other words, the line width of the first resonant line 105 is defined by the inner circumference contour and outer circumference contour, and the space occupied by the first resonant line 105 is defined by the outer circumference contour.

The width W3 of the first gap 131 (the length of the first gap 131 in the X axis direction in FIG. 4A) is restricted by substrate line design rules, and in Embodiment 1, the width W3 is a predetermined length less than or equal to four line widths of the first resonant line 105. Setting the width W3 to this sort of length increases the electromagnetic field confinement efficacy.

Note that, as illustrated in FIG. 4A, in Embodiment 1, the first gap 131 is positioned at a distance L3 from the line A-A' that splits the horizontal width L2 of the first resonant line 105 into a 1:1 ratio.

The input line 103 is formed in a straight line shape, connected to the first resonant line 105, and receives an input of a signal to be transmitted. The input line 103 is formed in a straight line shape that extends in the X axis direction in FIG. 4A.

The input line 103 is connected to the first resonant line 105 at a position less than or equal to a half line length of the first resonant line 105 from the first end 131*a* of the first resonant line 105. More specifically, with respect to the edges of the outer contour of the first resonant line 105, the input line 103 is connected at a position less than or equal to one half of the outer contour line length of the first resonant line 105 from the edge of the first end 131*a* of the first resonant line 105.

From the perspective of the portion of the input line 103 connected to the first resonant line 105 (the first connection point), the first resonant line 105 branches into two lines (the line including the first end 131*a* and the line including the second end 131*b*).

The first connecting line 107 (the first grounding part) grounds the first end 131*a* the first resonant line 105 by connecting the first end 131*a* of the first resonant line 105 to the first ground line 111. Note that here, grounding means connection to, for example, a line acting as a reference potential of signals input into the first resonator 101. The first resonant line 105 being connected to the first ground line 111 at the first end 131*a* is a characterizing feature of the resonant coupler 10, the advantageous effects of which will be described in detail later.

The first ground lines 111 and 112 are lines indicating a reference potential of a signal to be transmitted in the first dielectric substrate 121. The first ground lines 111 and 112 are disposed peripheral to the first resonant line 105. More specifically, the first ground lines 111 and 112 are disposed along the first resonant line 105 at a predetermined distance L4 from the first resonant line 105, and surround the first resonant line 105.

By disposing the first ground lines 111 and 112 along the input line 103 and the first resonant line 105 and proximate to the input line 103 and the first resonant line 105, the capacitance component between the first ground lines 111 and 112 and the input line 103 and first resonant line 105 can be increased. Thus, the operating frequency of the resonant coupler 10 can be decreased.

In Embodiment 1, the predetermined distance L4 is, for example, approximately 1.5 times the line width W1 of the first resonant line 105, but may be longer or shorter than the line width W1.

Moreover, in Embodiment 1, the first ground lines 111 and 112 are disposed at the predetermined distance L4 from the first resonant line 105, around the entire perimeter of the first resonant line 105, but the predetermined distance L4 is not required to be constant around the entire perimeter of the first resonant line 105.

The first end of the first ground line 111 is connected to the first end 131*a* of the first resonant line 105 via the first connecting line 107. The second end side of the first ground line 111 is disposed parallel to the input line 103, and extends along the input line 103.

The first ground gap 135 is an opening that opens a portion of the first ground line and divides (disconnects) the first ground line 111 from the first ground line 112. In other words, the first end of the first ground line 112 and the first end of the first ground line 111 form the first ground gap 135. In other words, the first ground line 111 and the first ground line 112 are disposed proximate to one another, separated across the first ground gap 135. The width (length in the X axis direction in FIG. 4A) of the first ground gap 135 is width W3. In Embodiment 1, similar to the first gap 131, the first ground gap 135 is positioned at a distance L3 from the line A-A', but it is not absolutely necessary to set the first ground gap 135 in the same position as the first gap 131.

The second end side of the first ground line 112 is disposed parallel to the input line 103, and extends along the input line 103. Note that the first ground gap 135 is not required.

In this way, the second end side of the first ground line 111 and the second end side of the first ground line 112 are disposed along the input line 103 so as to sandwich the input line 103. In other words, the input line 103 has a grounded coplanar structure. With the structure according to Embodiment 1, in which the first ground lines 111 and 112 are disposed substantially parallel to the input line 103 so as to sandwich the input line 103, the operating frequency can be decreased assuredly. Moreover, due to the grounded coplanar structure, external radiation can be inhibited and signal transmission efficiency of the resonant coupler can be increased.

Note that the line width W2 of the first ground lines 111 and 112 is substantially constant, but the line width W4 of the portion disposed along the input line 103 is slightly larger than the line width W2.

Note that the second end of the first ground line 111 and the second end of the first ground line 112 may be connected by a line.

Next, the second resonator 102 will be described with reference to FIG. 4B. FIG. 4B illustrates the structure of the second resonator 102.

In Embodiment 1, the second resonator 102 (the second resonant line 106) has symmetry about line A-A' with first resonator 101 (the first resonant line 105). As such, detailed description of the second resonator 102 will be omitted.

Figure 4B:
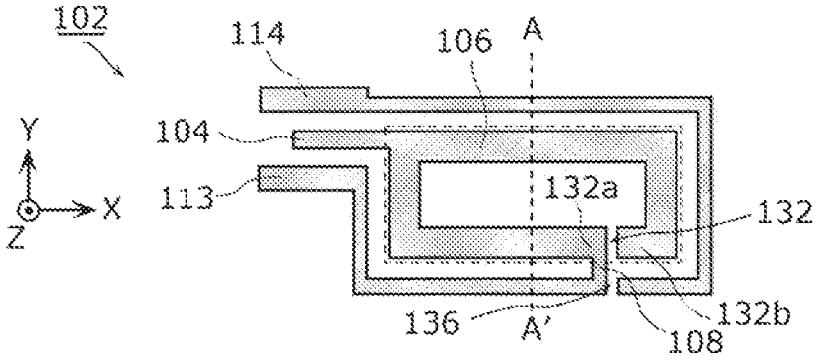
FIG. 4B illustrates the structure of the second resonator.

As illustrated in FIG. 4B, similar to the first resonant line 105, a portion of the closed loop shape of the second resonant line 106 is opened by the second gap 132. In other words, the second resonant line 106 is formed in a loop shape as the result of the first end 132*a* and the second end 132*b* being proximately located. Here, the first end 132*a* of the second resonant line 106 and the second end 132*b* of the second resonant line 106 form the second gap 132. In Embodiment 1, the second resonant line 106 is formed in a loop shape having a rectangular contour. The quadrilateral shape indicated by the dashed line in FIG. 4B is the contour of the second resonant line 106.

The output line 104 is formed in a straight line shape, connected to the second resonant line 106, and outputs a signal to be transmitted. The output line 104 is formed in a straight line shape that extends in the X axis direction in FIG. 4B.

The second connecting line 108 (the second grounding part) grounds the first end 132*a* of the second resonant line 106 by connecting the first end 132*a* of the second resonant line 106 to the second ground line 113.

The second ground lines 113 and 114 are lines indicating a reference potential of a signal to be transmitted in the second dielectric substrate 122. The second ground lines 113 and 114 are disposed along the second resonant line 106 at a predetermined distance from the second resonant line 106, and surround the second resonant line 106.

Moreover, the second ground lines 113 and 114 are disposed along the output line 104. In other words, the output line 104 has a grounded coplanar structure.

Next, the positional relationship between the first resonator 101 and the second resonator 102 will be described. In resonant coupler 10, the first resonator 101 and the second resonator 102 are disposed across from one another, as described above.

Figure 4C:
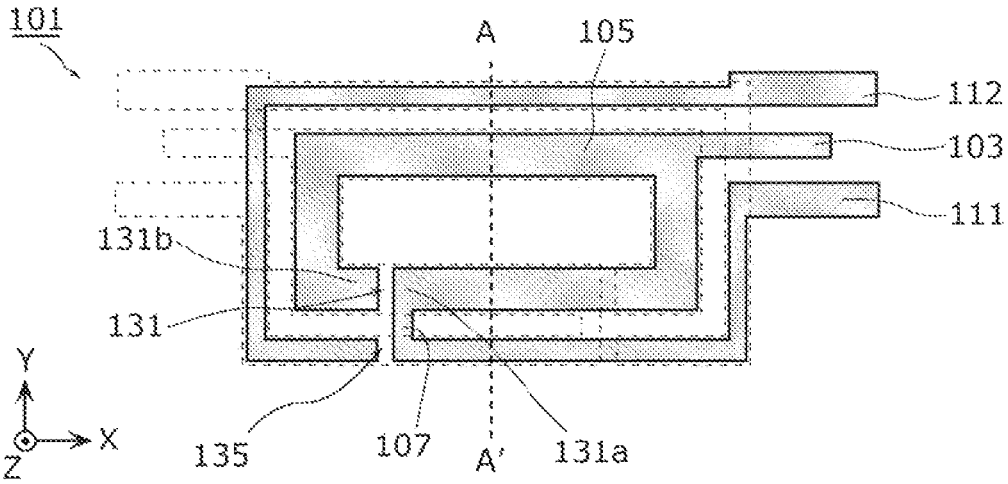
FIG. 4C illustrates the positional relationship between the first resonator and the second resonator.

FIG. 4C illustrates the positional relationship between the first resonator 101 and the second resonator 102. The dashed line in FIG. 4C indicates the shape of the second resonator 102.

As illustrated in FIG. 4C, when viewed in a direction perpendicular to the main surface of the first dielectric substrate 121, the contour of the first resonant line 105 and the contour of the second resonant line 106 substantially match. Here, substantially match means essentially matching to a degree that the resonant coupler 10 is operable. More specifically, here, substantially matching contours means essentially matching, including variations arising from assembly of the first dielectric substrate 121 and the second dielectric substrate 122, as well as variations in the sizes of the first resonant line 105 and the second resonant line 106 arising from manufacturing processes.

In other words, the contours substantially matching is not limited to the contours matching exactly; the resonant coupler 10 can still operate even if there is some difference between the contours of the resonant lines. Moreover, for example, the contours substantially matching also includes cases in which the line width of the first resonant line 105 and the line width of the second resonant line 106 are different thereby resulting in a difference in contours.

Moreover, as described above, the first resonant line 105 and the second resonant line 106 have a combined shape that is symmetrical about the line A-A' in FIG. 4C. Here, symmetrical about a line means essentially symmetrical about a line. For example, when the line width of the first resonant line 105 and the line width of the second resonant line 106 are slightly different, so long as the shapes of the resonant lines, including the positions of the gaps, are essentially symmetrical about a line, they can be said to have linear symmetry.

Note that in Embodiment 1, when the main surface of the first dielectric substrate 121 is divided into two regions by the line A-A', the input line 103 may be positioned in a first of the two regions, and the output line 104 may be positioned in the second of the two regions. However, as described above, the positions of the input line 103 and the output line 104 are not necessarily required to fulfill this sort of relationship.

Moreover, in Embodiment 1, the first resonator 101 and the second resonator 102 have a combined shape that is symmetrical about a line, but at least the first resonant line 105 and the second resonant line 106 may have a combined shape that is symmetrical about a line.

(Characterizing Structure)

As described above, a characterizing aspect of the first resonant line 105 and the second resonant line 106 is that they are grounded at one end. Note that, as exemplified above, since the first resonant line 105 and the second resonant line 106 have a combined shape that is symmetrical about a line, the following description will include only descriptions of the first resonant line 105.

Figure 5:
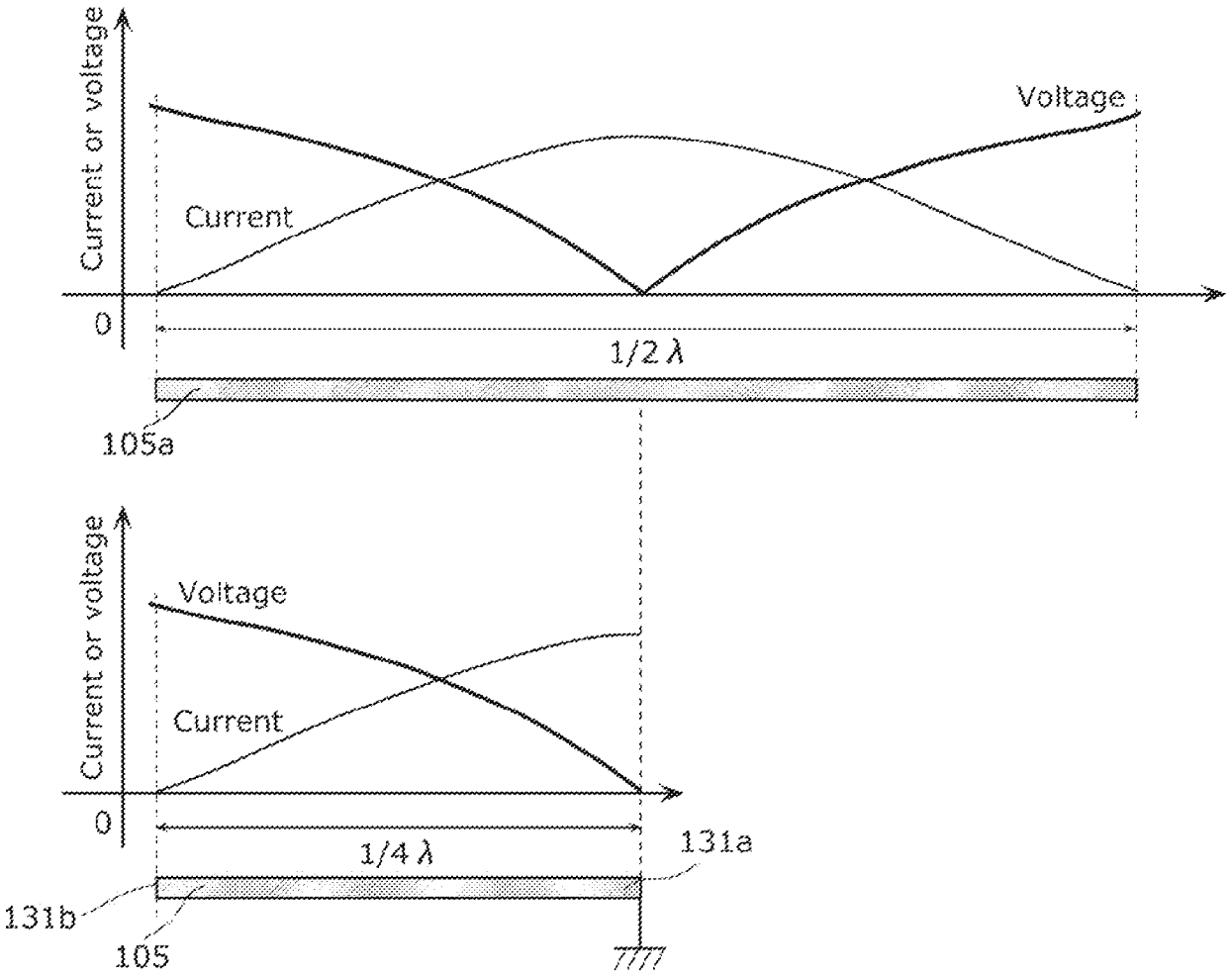
FIG. 5 schematically illustrates the relationship between points on the resonant line and voltage and current at those points, when an operating frequency signal is input into the resonant line.

FIG. 5 schematically illustrates the relationship between points on the resonant line and voltage and current at those points, when an operating frequency signal is input into the resonant line. Note that in FIG. 5, the loop-shaped resonant line is schematically depicted as a straight line.

As illustrated in the top graph in FIG. 5, the conventional resonant line 105*a* has a line length (the length from the first end to the second end of the resonant line 105*a*) that is one-half the wavelength of the signal to be transmitted, and by setting the line length in this way, the signal resonates.

Here, the voltage at the center of the resonant line 105*a* in the top graph in FIG. 5 is 0, and variations in the current and voltage are symmetrical about the center. Focusing on this point, the inventors discovered grounding the first end 131*a* of the first resonant line 105, as illustrated in the bottom graph in FIG. 5. This makes it possible to shorten the line length of the first resonant line 105 to one-fourth the wavelength of the signal to be transmitted.

In other words, with the first resonant line 105 of the resonant coupler 10, so long as the wavelength (operating frequency) of the signal to be transmitted is the same, the line length can be reduced to half the conventional size and resonance equivalent that achieved with the resonant line 105*a* can be achieved. The resonant coupler 10 can thus be manufactured to be smaller than a conventional resonant coupler having the same operating frequency. In other words, with the resonant coupler 10, so long as the line length of the resonant line is the same, the operating frequency can be significantly reduced compared to conventional technology.

Note that the first end 131*a* of the first resonant line 105 may be grounded by being connected to the rear ground line 124 with a via hole. Similarly, the first end 132*a* of the second resonant line 106 may be grounded by being connected to the cap ground line 125 with a via hole. In this case, the first ground lines 111 and 112, as well as the second ground lines 113 and 114, are not required.

(Operation)

The resonant coupler 10 is an element that transmits an electrical signal in an operating frequency band, with the input line 103 and the output line 104 functioning as input/output terminals. For example, a high frequency signal inputted from the input line 103 of the first resonator 101 is inputted to the first resonant line 105.

As described above, the first end 131*a* of the first resonant line 105 is connected to the first ground line 111 via the first connecting line 107. In other words, the first end 131*a* of the first resonant line 105 is a short-circuited end, and the second end 131*b* of the first resonant line 105 is an open end.

Thus, when the distance (line length) from the first end 131*a* (short-circuited end) of the first resonant line 105 to the second end 131*b* (open end) is set to one-fourth the effective wavelength of the inputted high frequency signal, this high frequency signal resonates in the first resonant line 105 (first resonator 101). In other words, the first resonator 101 operates as a one-fourth lambda resonator.

Here, since the second resonator 102 has the same structure, the second resonator 102 also operates as a one-fourth lambda resonator similar to the first resonator 101.

As described above, the first resonator 101 (the first resonant line 105) and the second resonator 102 (second resonant line 106) are disposed across from one another in a direction perpendicular to the main surface of the first dielectric substrate 121 (in the Z axis direction). Similarly, when viewed in a direction perpendicular to the main surface of the first dielectric substrate 121, the first resonant line 105 and the second resonant line 106 have substantially matching contours.

With this configuration, the first resonant line 105 and the second resonant line 106 resonate at the operating frequency, which excites the same electromagnetic field in the second resonant line 106 as the first resonator 101. In other words, the high frequency signal inputted to the input line 103 is wirelessly transmitted to the second resonant line 106 and outputted from the output line 104.

Conversely, when an electrical signal is inputted to the output line 104, the second resonant line 106 resonates with the first resonant line 105, thereby exciting the same electromagnetic field in the first resonant line 105 as the second resonant line 106. In other words, the high frequency signal inputted to the output line 104 resonates at the second resonant line 106, is wirelessly transmitted to the first resonant line 105, and outputted from the input line 103.

Note that in Embodiment 1, the distance between the first resonant line 105 and the second resonant line 106 measured in a direction perpendicular to the main surface of the first dielectric substrate 121 (the Z axis direction), i.e., the thickness of the second dielectric substrate 122, is preferably no more than approximately one-half the wavelength of the high frequency signal in the operating frequency band. Note that the wavelength of the high frequency signal here is determined based on the wavelength shortening rate dependent on the line material used to transmit the signal and the wavelength shortening rate dependent on the dielectric material disposed between the first resonant line 105 second resonant line 106. In Embodiment 1, this wavelength shortening rate is determined based on gold, which is the line material used, and sapphire, which is the substrate material used.

In order for the first resonant line 105 and the second resonant line 106 to achieve stronger electromagnetic resonant coupling, the insertion loss and such, which is to be described later, can be reduced and the transmission efficiency of the signal can be increased.

Next, the transmission characteristics of the signal by the resonant coupler 10 will be described.

Figure 6:
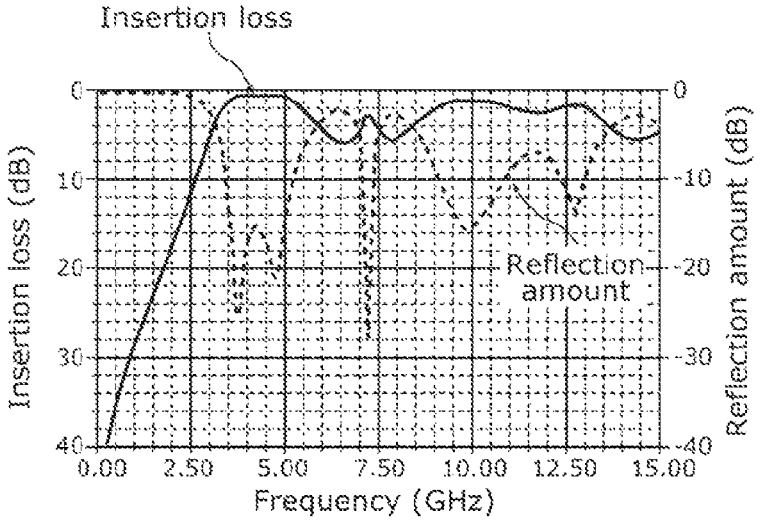
FIG. 6 illustrates the signal transmission characteristics of the resonant coupler.

FIG. 6 illustrates the signal transmission characteristics of the resonant coupler 10. The horizontal axis represents the high frequency signal input into the resonant coupler 10, and the vertical axis on the left of FIG. 6 represents insertion loss in decibels. The smaller the insertion loss value is, the higher the probability the signal can be transmitted without loss and the better the transmission efficiency is. The vertical axis on the right in FIG. 6 represents reflection amount in decibels. Higher values of reflection amount indicate greater reflection and thus degradation of the transmission efficiency.

First, the main dimensions of the resonant coupler having the transmission characteristics indicated in FIG. 6 will be described.

The thickness (length in the Z axis direction) of the first dielectric substrate 121 is 0.1 mm, the thickness (length in the Z axis direction) of the second dielectric substrate 122 is 0.2 mm, and the thickness of the third dielectric substrate 123 is 0.3 mm. As described above, all of the substrates are sapphire substrates.

The line width (line width W2) of the input line 103, the output line 104, the first ground lines 111 and 112, and the second ground lines 113 and 114 is 0.1 mm. The line width (line width W1) of the first resonant line 105 and the second resonant line 106 is 0.2 mm.

The line width W4 of the portions of the first ground lines 111 and 112 that extend along the input line 103 and the portions of the second ground lines 113 and 114 that extend along the output line 104 is 0.16 mm.

The horizontal width L2 of the first resonant line 105 and the second resonant line 106 is 1.8 mm and the vertical width L1 of the same is 0.8 mm. The distance L3 that indicates the positions of the first ground gap 135 and the second ground gap 136 is 0.3 mm.

As illustrated in FIG. 6, the resonant coupler 10 having the dimensions described above can transmit, with substantially zero loss, a signal having a frequency around spanning roughly a 2 GHz band centered around 4.3 GHz.

As exemplified above, the resonant coupler 10 can be manufactured to be substantially more compact than a conventional resonant coupler while maintaining transmission efficiency.

Note that the position where the input line is connected to the first resonant line 105 (the first connection point) is not limited to the example illustrated in, for example, FIG. 4A. In the resonant coupler 10, the input (output) impedance of the first resonator 101 is determined based on the relationship between the length from the first end 131*a* of the first resonant line 105 to the first connection point and the length from the first connection point to the second end 131*b*. In other words, the input impedance can be adjusted by adjusting the position of the first connection point.

As such, when the input impedance of the first resonator 101 and the input impedance of the second resonator 102 are set to different impedances, the position on the first resonant line 105 at which the input line 103 is connected and the position on the second resonant line 106 at which the output line 104 is connected may have a different positional relationship (i.e., may have a positional relationship that does not result in symmetry about a line).

Furthermore, the impedances of the first resonator 101 and the second resonator 102 can be adjusted by designing the first resonant line 105 and the second resonant line 106 to have different line widths. Moreover, the impedances can be adjusted by designing the gap (the predetermined distance L4) between the first resonant line 105 and the first ground lines 111 and 112 to be different from the gap between the second resonant line 106 and the second ground lines 113 and 114. In this way, the resonant coupler 10 operates even when the input impedances are different between the resonators.

Embodiment 2

In Embodiment 1, the first gap 131 and the first ground gap 135 are located at a positions distanced from the line A-A' by distance L3, but the locations of the first gap 131 and the first ground gap 135 are not limited to this example.

Hereinafter, the resonant coupler 20 according to Embodiment 2 will be described. Note that the only difference between the resonant coupler 20 and the resonant coupler 10 is in the line structures of the first resonator and the second resonator. The following description will therefore focus on this difference.

Figure 7A:
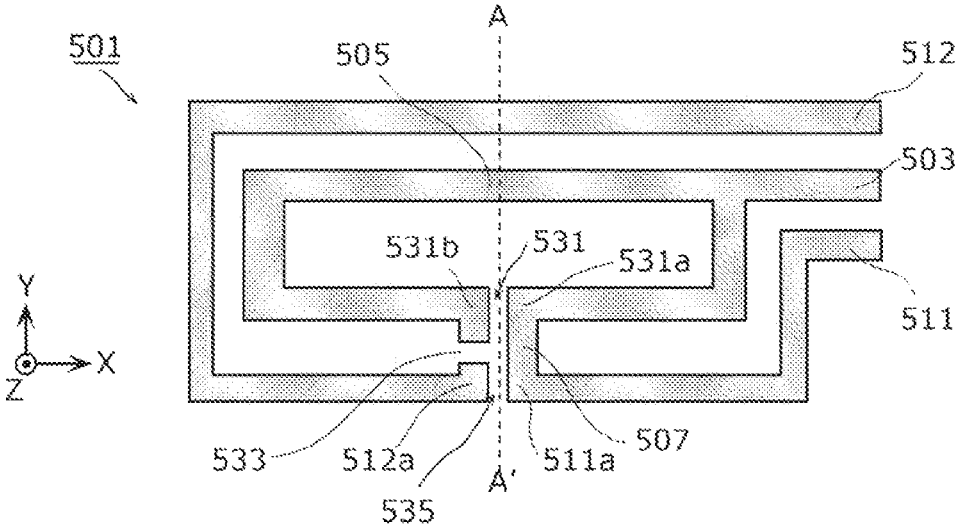
FIG. 7A illustrates the structure of the first resonator of the resonant coupler according to Embodiment 2.
Figure 7B:
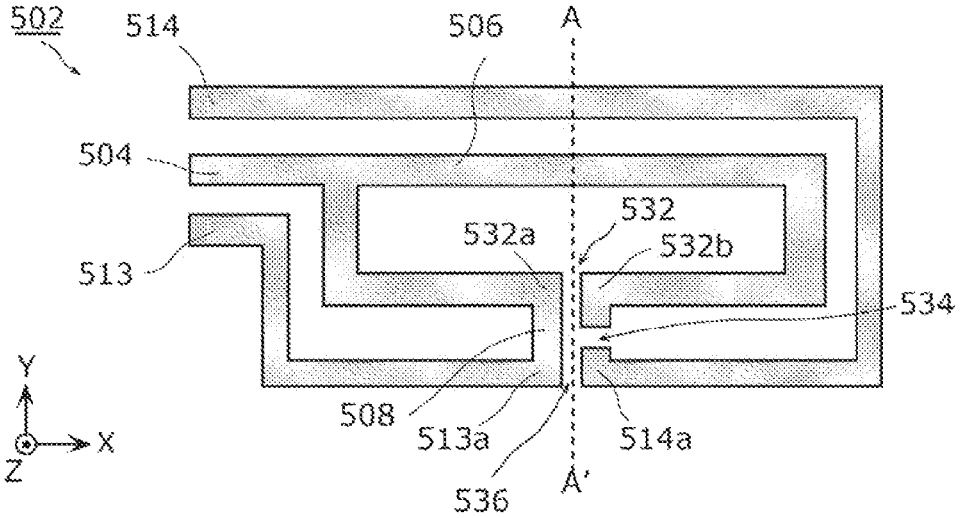
FIG. 7B illustrates the structure of the second resonator of the resonant coupler according to Embodiment 2.

First, the first resonator and the second resonator of the resonant coupler 20 will be described with reference to FIG. 7A and FIG. 7B. FIG. 7A illustrates the structure of the first resonator of the resonant coupler 20 according to Embodiment 2. FIG. 7B illustrates the structure of the second resonator of the resonant coupler 20.

As illustrated in FIG. 7A, in the first resonator 501, the first gap 531 and the first ground gap 535 are positioned in the center of the first resonant line 505, i.e., positioned on the line A-A'. Similar to Embodiment 1, the first gap 531 is an opening formed by the first end 531*a* and the second end 531*b* of the first resonant line 505.

Similarly, as illustrated in FIG. 7B, in the second resonator 502, the second ground gap 536 is positioned in the center of the second resonant line 506, i.e., positioned on the line A-A'. The second gap 532 is an opening formed by the first end 532*a* and the second end 532*b* of the second resonant line 506.

Moreover, as illustrated in FIG. 7A, the first auxiliary line 509 is connected to the second end 531*b* of the first resonant line 505.

The first auxiliary line 509 has a first end connected to the second end 531*b* of the first resonant line 505, and is disposed outside the contour of the first resonant line 505. The second end of the first auxiliary line 509 is disposed so as to be proximate to the first end 512*a* of the first ground line 512. In other words, the second end of the first auxiliary line 509 and the first end 512*a* of the first ground line 512 form the third gap 533.

More specifically, the second end of the first auxiliary line 509 is positioned less than or equal to four line widths of the first auxiliary line 509 from the first end 512*a* of the first ground line 512. Here, the line width of the first auxiliary line 509 refers to the length in the X axis direction in FIG. 7A, and is substantially the same as the line width of the first resonant line 505.

As described above, the input line 503 is connected to the first resonant line 505, and the first end 531*a* of the first resonant line 505 is connected to the first ground line 511 via the first connecting line 507.

Similarly, as illustrated in FIG. 7B, the output line 504 is connected to the second resonant line 506, and the second auxiliary line 510 is connected to the second end 532*b* of the second resonant line 506.

The second auxiliary line 510 has a first end connected to the second end 532*b* of the second resonant line 506, and is disposed outside of the contour of the second resonant line 506. The second end of the second auxiliary line 510 is disposed so as to be proximate to the first end 514*a* of the second ground line 514. In other words, the second end of the second auxiliary line 510 and the first end 514*a* of the second ground line 514 form the fourth gap 534.

More specifically, the second end of the second auxiliary line 510 is positioned less than or equal to four line widths of the second auxiliary line 510 from the first end 514*a* of the second ground line 514. Here, the line width of the second auxiliary line 510 refers to the length in the X axis direction in FIG. 7B, and is substantially the same as the line width of the second resonant line 506.

Note that, similar to Embodiment 1, the first end 532*a* of the second resonant line 506 is connected to the second ground line 513 via the second connecting line 508.

Note that, similar to Embodiment 1, the first dielectric substrate 521 included in the first resonator 501 and the second dielectric substrate 522 included in the second resonator 502 are disposed across from one another. In this case, when viewed in a direction perpendicular to the main surface of the first dielectric substrate, the contour of the first resonant line 505 and the contour of the second resonant line 506 substantially match, and the first resonant line 505 and the second resonant line 506 have a combined shape that is symmetrical about a line.

With this structure, a resonant coupler 20 having a low operating frequency and favorable transmission characteristics can be realized.

Moreover, the inclusion of the first ground gap 535 in the resonant coupler 20 according to Embodiment 2 is one characterizing feature of the resonant coupler 20. With this, the operating frequency of the resonant coupler 20 can be substantially decreased.

Figure 8:
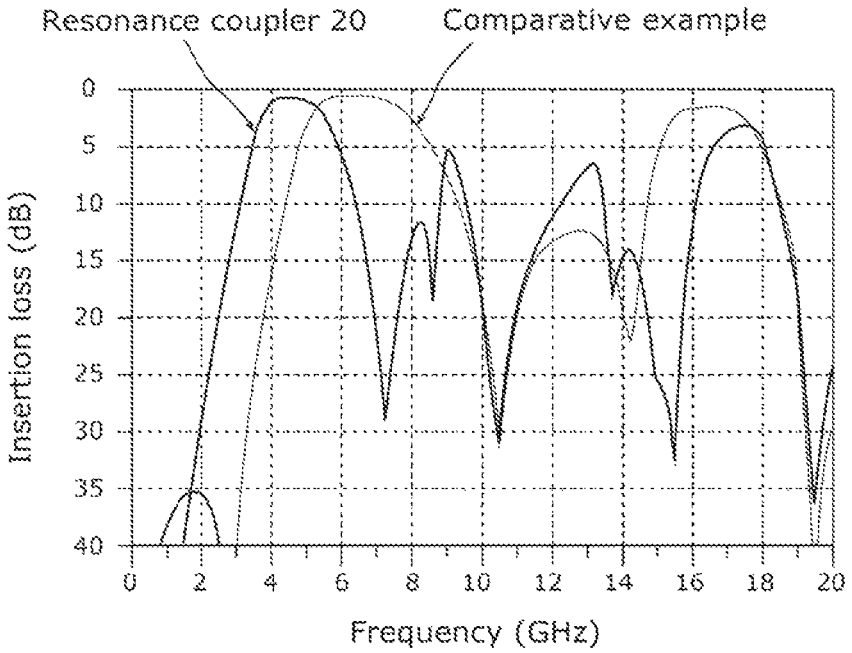
FIG. 8 illustrates insertion loss in the resonant coupler according to Embodiment 2.

FIG. 8 illustrates insertion loss in the resonant coupler 20 according to Embodiment 2. Note that FIG. 8 also illustrates a comparative example of when the resonant coupler 20 does not include the first ground gap 535 and the second ground gap 536.

Note that omission of the first ground gap 535 means that the first end 511*a* of the first ground line 511 and the first end 512*a* of the first ground line 512 are connected by a line, and the first ground line 511 and the first ground line 512 surround the first resonant line 505 as a single line.

Similarly, omission of the second ground gap 536 means that the first end 513*a* of the second ground line 513 and the first end 514*a* of the second ground line 514 are connected by a line, and the second ground line 113 and the second ground line 114 surround the second resonant line 506 as a single line.

As illustrated in FIG. 8, inclusion of the first ground gap 535 and the second ground gap 536 in the resonant coupler 20 substantially reduces the operating frequency. In other words, the resonant coupler 20 can be manufactured to be significantly smaller than other resonant couplers that operate at the same frequency.

Note that the first resonant line 505 and the second resonant line 506 are 1.78 mm across (in FIG. 7A and FIG. 7B, this is equivalent to L2 in FIG. 4A) and 0.73 mm vertically (in FIG. 7A and FIG. 7B, this is equivalent to L1 in FIG. 4A).

Embodiment 3

Hereinafter, a resonant coupler according to Embodiment 3 capable of being even more compactly manufactured will be described. Note that the only difference between the resonant coupler according to Embodiment 3 and the resonant couplers 10 and 20 is in the line structures of the first resonator and the second resonator; other structures are the same. Moreover, since the fact that the first resonator and the second resonator have a combined shape that is symmetrical about a line is the same as in Embodiments 1 and 2, the following example will focus on the differences regarding the first resonator.

A characterizing feature of the first resonator in the resonant coupler according to Embodiment is that it includes a single resonant line configured of the first resonant line and a meander line connected to the first resonant line.

Figure 9:
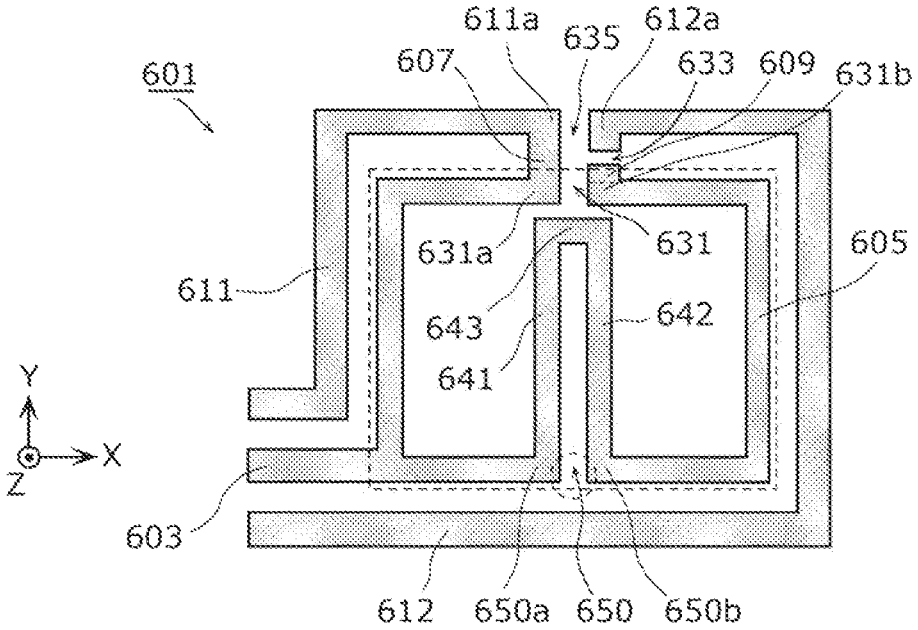
FIG. 9 illustrates the structure of the first resonator according to Embodiment 3.

FIG. 9 illustrates the structure of the first resonator according to Embodiment 3.

The first resonator 601 includes a first resonant line 605, an input line 603, a meander line (first line 641, second line 642, and third line 643), a first connecting line 607, first ground lines 611 and 612, and a first auxiliary line 609. Note that in the following example, the first line 641, the second line 642, and the third line 643 are collectively referred to as the meander line 640.

The portion of the first resonant line 605 enclosed by the dashed line in FIG. 9, excluding the meander line 640, has a rectangular loop shape. Note that, similar to Embodiments 1 and 2, the first end 631*a* of the first resonant line 605 is connected to the first end 611*a* of the first ground line 611 via the first connecting line 607. Moreover, similar to Embodiment 2, the second end of the first auxiliary line 609 connected to the second end 631*b* of the first resonant line 605, and the first end 612*a* of the first ground line 612 form the third gap 633.

Note that the first ground lines 611 and 612 are disposed around the perimeter of the first resonant line 605, and the first end 611*a* of the first ground line 611 and the first end 612*a* of the first ground line 612 form the first ground gap 635. Note that the first ground gap 635 is not required.

Here, unlike Embodiments 1 and 2, the first resonant line 605 includes a first opening 650 midline (in a portion of the line). In other words, the first resonant line 605 is divided into two lines by the first opening 650.

The two ends 650*a* and 650*b* of the first resonant line 605 forming the first opening 650 are connected via the meander line 640.

In a view in a direction perpendicular to the main surface of the first dielectric substrate 121 including the first resonant line 605, the meander line 640 is disposed inside the contour of the first resonant line 605 (in the region surrounded by the dashed line in FIG. 9). As described above, in Embodiment 3, the meander line 640 includes the first line 641 having a first end connected to the end 650*a*, the second line 642 having a first end connected to the end 650*b*, and the third line 643 connecting the second end of the first line 641 with the second end of the second line 642.

Here, the first line 641 and the second line 642 are formed in a straight line shape extending in a direction perpendicular to the input line 603 (extending in the Y axis direction in the figure). Here, the third line 643 and the input line 603 are formed in a straight line shape extending parallel to the input line 603 (extending in the X axis direction in the figure). Note that in Embodiment 3, the line width of the first line 641, the line width of the second line 642, and the line width of the third line 643 are equal to the line width of the first resonant line 605.

In this way, with a configuration which includes the meander line 640 in addition to the first resonant line 605 as a single resonant line, the line length of the single resonant line can be extended by the line length of the meander line 640. Since the space occupied by the single resonant line (the area enclosed by the dashed line in FIG. 9) is the same as when the meander line 640 is not included, the line length can be extended while maintaining the same amount of occupied space, thereby making it possible to decrease the operating frequency. In other words, the resonant coupler can be manufactured to be even more compact.

Moreover, by disposing the meander line 640 inside the contour of the first resonant line 605, the wiring becomes denser. In other words, there is a high proportion of lines in the area surrounded by the dashed line in FIG. 9. This has an advantageous effect of increasing the inductance component (L value in Equation 1) of the single resonant line, whereby the operating frequency of the resonant coupler reduces more so than when the line length is simply extended.

Moreover, the electromagnetic field generated by the high frequency signal resonance spreads and propagates through the line width. Spreading of the electromagnetic field is determined based on degree of confinement, but the electromagnetic field generally spreads approximately four line widths. In other words, when the impedance of the single resonant line is to be increased to strengthen the electromagnetic field, a region is preferably provided on the substrate in which lines are proximately located less than or equal to four line widths apart from one another.

Moreover, densely disposing the single resonant line in the portion of the line where the first gap 631 is formed has an advantageous effect of increasing the self-capacitance component (C value in Equation 1) of the single resonant line. In this case, when the self-capacitance is desired to be increased even further, the first gap 631 may be disposed less than or equal to four line widths. This further reduces the operating frequency.

In Embodiment 3, the third line 643 is disposed proximate to the portion of the first resonant line 605 where the first gap 631 is formed, separated by less than or equal to approximately four line widths in the Y axis direction in FIG. 9. Moreover, the first line 641 and the second line 642 are disposed proximate to one another. With this, the operating frequency in the resonant coupler according to Embodiment 3 can be significantly reduced, more so than simply extending the line length.

As exemplified above, with the resonant coupler according to Embodiment 3, providing the meander line allows for the operating frequency to be further reduced. Thus, compared to a resonant coupler that operates at the same frequency, the resonant coupler according to Embodiment 3 can be manufactured to be significantly smaller.

Note that the meander line is not required to be formed in the squared C-shape (bracket shape). For example, the meander line may have an arc-like shape or any other shape. The meander line may simply connect the ends of the first resonant line that form the opening, and be disposed within the outline of the first resonant line.

(Variation)

Hereinafter, a variant resonant coupler will be described. Note that the only difference between the variant resonant coupler and the resonant couplers according to the above Embodiments is the line structures of the first resonator and the second resonator; other structures are the same. Moreover, since the fact that the first resonator and the second resonator have a combined shape that is symmetrical about a line is the same as in Embodiments 1 and 2, the following example will focus on the differences regarding the first resonator.

In Embodiment 3, the first resonator is exemplified as including a meander line, but two or more meander lines may be provided.

Figure 10:
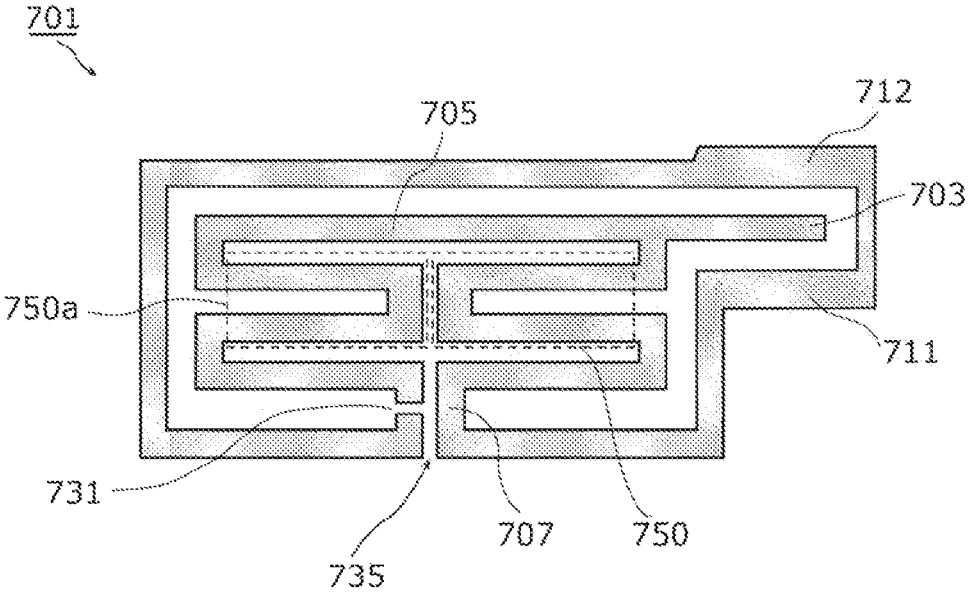
FIG. 10 illustrates an example of the first resonator when the first resonator includes two meander lines.

FIG. 10 illustrates an example of the first resonator when the first resonator includes two meander lines.

The first resonator 701 illustrated in FIG. 10 includes openings 750*a* and 750*b* on the first resonant line 705, which is similar to the resonant line described in Embodiment 2. The two ends forming the opening 750*a* are connected via the meander line 740*a*, and the two ends forming the opening 750*b* are connected via the meander line 740*b*. In this way, the first resonant line may have a meandering line structure that includes a plurality of turns. Descriptions of the input line 703, the first ground lines 711 and 712, the first connecting line 707, the first gap 731, and the first ground gap 735 are omitted as they are the same as in Embodiment 2.

As illustrated in FIG. 10, note that the second end of the first ground line 711 and the second end of the first ground line 712 may be connected by line 715. This also applies to the first ground line described in the above embodiments.

Figure 11:
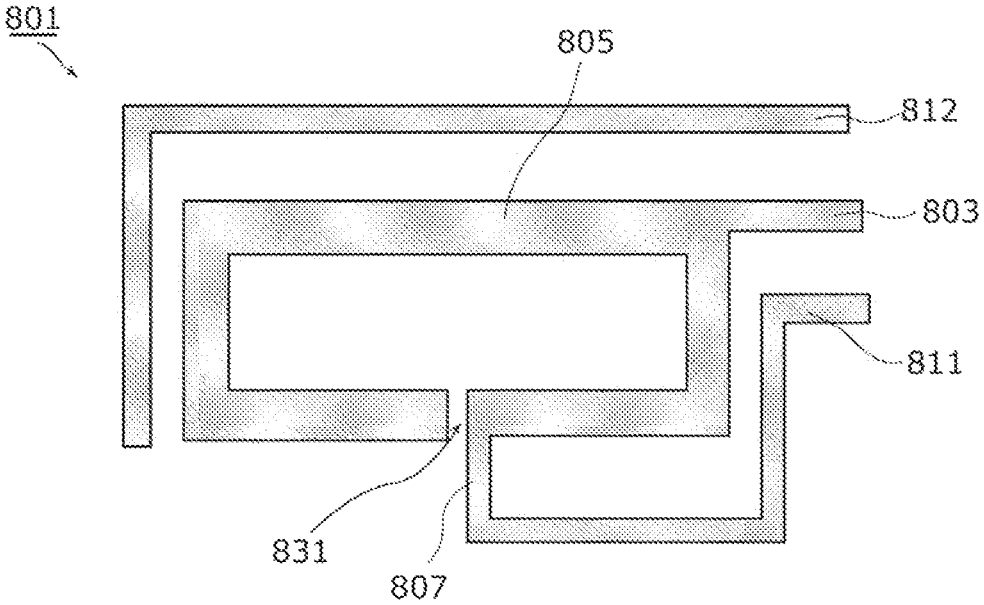
FIG. 11 illustrates an example of the first resonator when a portion of the first ground line is omitted.

Moreover, the first ground line need not be disposed around the entire perimeter of the first resonant line. FIG. 11 illustrates an example of the first resonator when a portion of the first ground line is omitted.

As illustrated in FIG. 11, in the first resonator 801, the first ground lines 811 and 812 are not required to completely surround the first resonant line 805. The first ground lines 811 and 182 may simply be disposed along a portion of the first resonant line 805. Even with this configuration, the advantageous effect of reducing of the operating frequency achieved by providing the first ground lines 811 and 812 and the improvements to the transmission characteristic are obtained in a definite quantity. Moreover, the first ground line may be a solid ground instead of a line as described above. Note that descriptions of the input line 803, the first connecting line 807, and the first gap 831 are omitted.

Moreover, in the above embodiments, the first resonant line is exemplified as being formed in a loop, but the first resonant line may be formed in a shape other than a loop.

Figure 12:
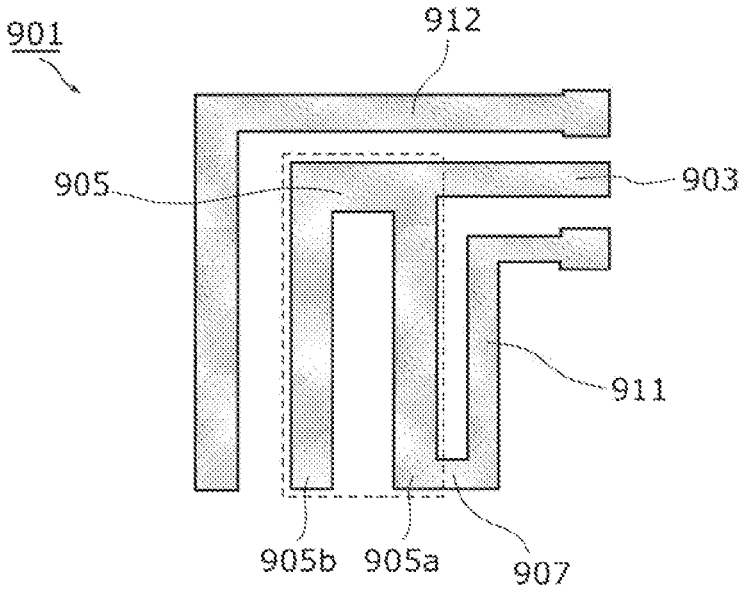
FIG. 12 illustrates an example of the first resonator when the first resonator includes a bracket-shaped first resonant line.

FIG. 12 illustrates an example of the first resonator when the first resonator includes a bracket-shaped first resonant line.

The first end 905*a* of the bracket-shaped first resonant line included in the first resonator 901 illustrated in FIG. 12 is connected to the first ground line 911 via the first connecting line 907. The second end 905*b* of the first resonant line 905 is an open end. The first ground lines 911 and 912 are disposed along the first resonant line 905 and the input line 903 connected to the first resonant line 905.

Moreover, the first resonant line may have a coil shape (spiral shape).

Figure 13:
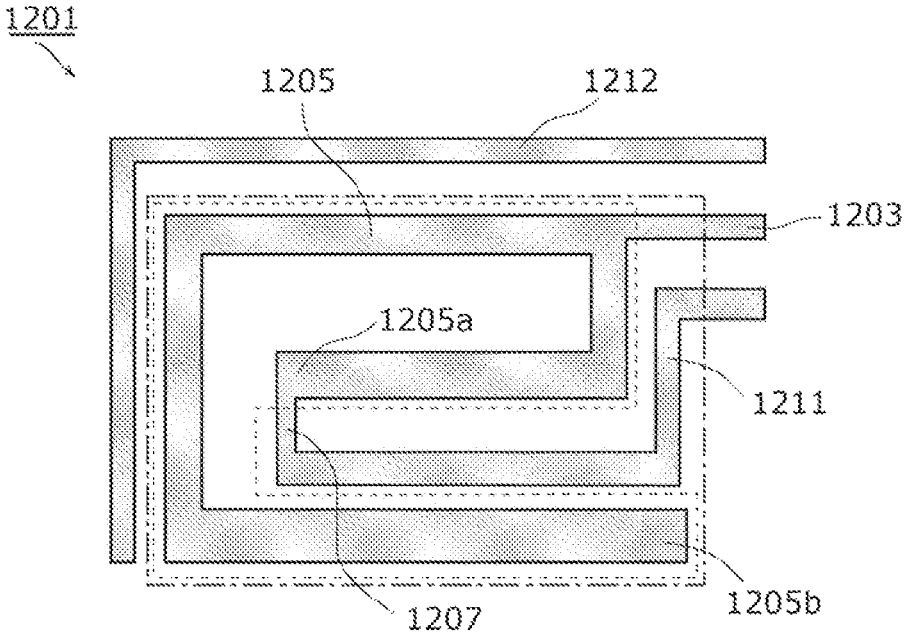
FIG. 13 illustrates an example of the first resonator when the first resonator includes a coil-shaped first resonant line.

FIG. 13 illustrates an example of the first resonator when the first resonator includes a coil-shaped first resonant line.

The coil-shaped first resonant line 1205 (the line disposed in the region enclosed by the dashed line in FIG. 13) included in the first resonator 1201 has a first end 1205*a* located inward that is connected to the first ground line 1211 via the first connecting line 1207. The outward located first end 1205*b* (second end) of the first resonant line 1205 is an open end. The first ground line 1212 is disposed along the first resonant line 1205 and the input line 1203 connected to the first resonant line 1205.

Note that when the first resonant line is formed in a coiled shape, as illustrated in FIG. 13, the outward located first end of the first resonant line may be grounded.

Figure 14:
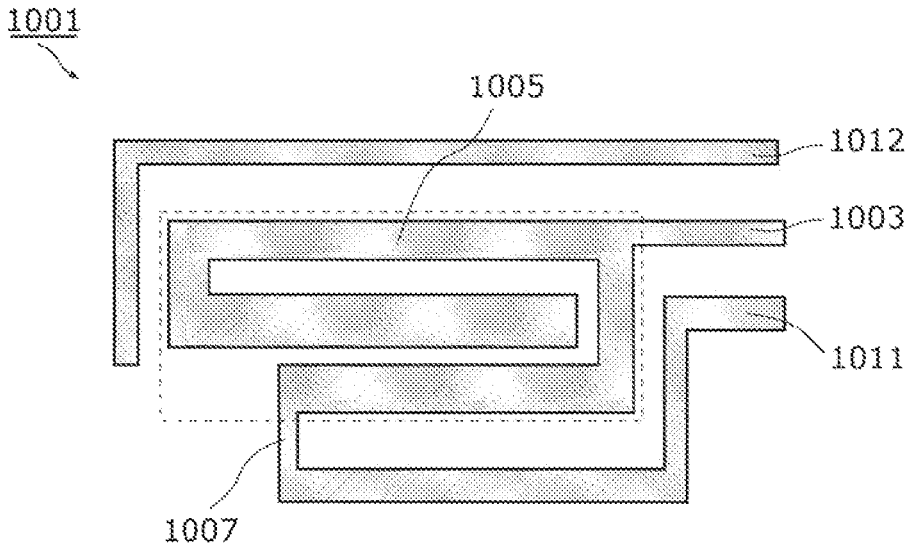
FIG. 14 illustrates a different example of a first resonator including a coil-shaped first resonant line.

FIG. 14 illustrates another example of a first resonator including a coil-shaped first resonant line.

The coil-shaped first resonant line 1005 (the line disposed in the region enclosed by the dashed line in FIG. 14) included in the first resonator 1001 has a first end 1005*a* located outward that is connected to the first ground line 1011 via the first connecting line 1007. The inward located first end 1005*b* (second end) of the first resonant line 1005 is an open end. The first ground line 1012 is disposed along the first resonant line 1005 and the input line 1003 connected to the first resonant line 1005.

Note that the coil-shaped first resonant line is not limited to the examples illustrated in FIG. 13 and FIG. 14 in which the coil shape is formed from straight lines; the coil-shaped first resonant line may be formed from curved lines.

In other words, when the first resonant line is formed in a coiled shape, the contour of the first resonant line is defined by the edge of the outer contour of the outermost line.

In other words, the contour of the first resonant line 1205 illustrated in FIG. 13 is defined by the rectangular shape indicated by the dotted and dashed line in FIG. 13. The contour of the first resonant line 1005 illustrated in FIG. 14 is defined by the rectangular shape indicated by the dashed line in FIG. 14.

The same also applies for when the first resonant line is formed in a circular shape: the contour of the first resonant line is an approximate circle or approximate eclipse defined by the edge of the outer contour of the outermost line.

Moreover, similar to when the first resonant line is loop-shaped, substantially match means essentially matching to a degree that the resonant coupler is operable when the first resonant line is coil-shaped as well.

Note that in the present description, loop, coil, and bracket shapes are defined as being circumferential shapes. Here, a circumferential shape refers to a shape where the line extends at least approximately once around something, such as the loop, coil, and bracket shapes described in the above embodiments. Moreover, here, a circumferential shape includes a coil shape where the line coils in multiple loops.

Moreover, the first resonant line may be circular.

Figure 15:
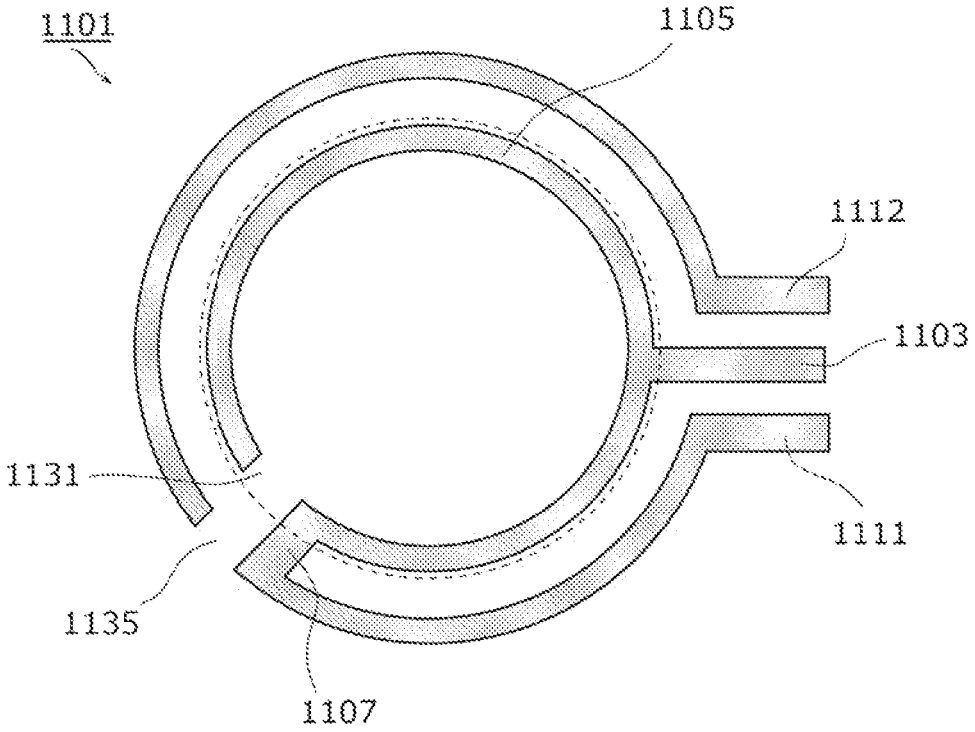
FIG. 15 illustrates an example of the first resonator when the first resonator includes a loop-shaped first resonant line having a circular contour.

FIG. 15 illustrates an example of the first resonator when the first resonator includes a loop-shaped first resonant line having a circular contour.

The loop-shaped first resonant line 1105 (the line disposed in the region enclosed by the dashed line in FIG. 15) having a circular contour and included in the first resonator 1101 has a first end 1131*a* that is connected to the first ground line 1111 via the first connecting line 1107. The contour of the first resonant line 1105 is circular, as indicated by the dashed line in FIG. 15.

The first end 1131*a* of the first resonant line and the second end 1131*b* of the first resonant line 1105 are proximately located, separated by a predetermined distance, thereby forming the first gap 1131. The predetermined distance is the length of the first gap 1131 measured in the circumferential direction.

The first ground lines 1111 and 1112 are disposed in circular shapes along the first resonant line 1105. Moreover, around the input line 1103 connected to the first resonant line 1105, the first ground lines 1111 and 1112 are formed in straight line shapes extending along and sandwiching the input line 1103.

Moreover, the first end 1111*a* of the first ground line 1111 and the first end 1112*a* of the first ground line 1112 form the first ground gap 1135.

Above, the resonant couplers including the first resonant lines exemplified with reference to FIG. 10 through FIG. 15 can be manufactured to be substantially more compact than a conventional resonant coupler while maintaining transmission efficiency, similar to the resonant couplers described in the embodiments.

(Additional Comments)

In one or more embodiment described above, the first dielectric substrate 121, the second dielectric substrate 122, and the third dielectric substrate 123 are sapphire substrates, but these substrates may be made of other materials such as polymer and ceramic. For example, the first dielectric substrate 121, the second dielectric substrate 122, and the third dielectric substrate 123 may be semiconductor substrates such as silicon, or electrically conductive substrates. Moreover, the first dielectric substrate 121, the second dielectric substrate 122, and the third dielectric substrate 123 may each be made of a different material.

The first resonator 101 (the first resonant line 105) and the second resonator 102 (the second resonant line 106) may simply be disposed across from one another. In other words, as described in Embodiment 1, there is no need to stack the substrates together; there may be a space between the substrates.

Moreover, the first dielectric substrate 121, the second dielectric substrate 122, and the third dielectric substrate 123 may each have a multilayer structure.

The rear ground line 124 and the cap ground line 125 are not essential elements. The rear ground line 124 and the cap ground line 125 are not required, and the third dielectric substrate 123 may also be omitted.

Moreover, a single substrate may include the first resonant line 105 on one main surface, and the second resonant line 106 on the other main surface. In this case, the resonant coupler 10 is not required to include the two substrates: the first dielectric substrate 121 and the second dielectric substrate 122.

In this embodiment, the input line and the output line have a grounded coplanar structure, but these lines may have a different coplanar structure or a microstrip structure.

The first resonant line 105 and the second resonant line 106 are exemplified as branching into two lines at the connection point connecting the input line and the output line, but the first resonant line 105 and the second resonant line 106 may branch into two or more lines.

The shape, line width, and size of the first resonator 101 are not required to exactly match the shape, line width, and size of the second resonator 102, respectively. Some dimensional variation between the first resonator 101 and the second resonator 102 is acceptable as this does not prevent the resonant coupler 10 from being able to transmit signals.

Moreover, in the above embodiments, a signal is transmitted by resonating two resonators, but a signal may be transmitted by resonating three or more resonators. In other words, the resonant coupler may further include a third resonator.

Moreover, in the above embodiments, the first resonant line is exemplified as being surrounded by the first ground lines 111 and 112, but the first resonant line is not required to be surrounded.

The third gap and the fourth gap may simply be such that the ends forming the gaps are proximately located; the ends need not be parallel with one another. Here, "proximate" means that the ends are separated from one another by a distance less than or equal to approximately four line widths of the first ground lines 111 and 112.

Note that in the above embodiments and variation, the first resonant line and the second resonant line are exemplified as having a combined shape that is symmetrical about a line, but the first resonant line and the second resonant line may have a combined shape that is symmetrical about a point. Even with this configuration, the first resonant line and the second resonant line are capable of electromagnetic resonant coupling.

Note that the resonant coupler is exemplified as including the first resonant line and the second resonant line, but the resonant coupler may include another resonant line (for example, a third resonant line). In this case, the resonant coupler includes a first resonant line, a second resonant line disposed above of the first resonant line, and a third resonant line disposed below the first resonant line. This allows the resonant coupler to, for example, output a plurality of output signal from a single input signal.

Hereinbefore a resonant coupler according to one aspect of the present invention has been described based on Embodiments 1 through 3 and a variation.

The herein disclosed subject matter is to be considered descriptive and illustrative only, and the appended claims are of a scope intended to cover and encompass not only the particular embodiment(s) disclosed, but also equivalent structures, methods, and/or uses.

INDUSTRIAL APPLICABILITY

The resonant coupler according to the present invention is capable of being compact and highly integrated, and is applicable as a wireless transmission apparatus used as a driving gate in inverter systems or matrix converter systems.

REFERENCE SIGNS LIST

10, 20 resonant coupler
101, 501, 601, 701, 801, 901, 1001, 1101, 1201 first resonator
102, 502 second resonator
103, 503, 603, 703, 803, 903, 1003, 1103, 1203 input line
104, 504 output line
105, 505, 605, 705, 805, 905, 1005, 1105, 1205 first resonant line
106, 506, second resonant line
107, 507, 607, 707, 807, 907, 1007, 1107, 1207 first connecting line
108, 508 second connecting line
111, 112, 511, 512, 611, 612, 711, 712, 811, 812, 911, 912, 1011, 1012, 1111, 1112, 1211, 1212 first ground line
113, 513, 114, 514 second ground line
121 first dielectric substrate
122 second dielectric substrate
123 third dielectric substrate
124 rear ground line
125 cap ground line
131, 531, 631, 731, 831, 1131 first gap
131*a*, 132*a*, 511*a*, 512*a*, 513*a*, 514*a* first end

531*a*, 532*a*, 611*a*, 612*a*, 631*a*, 905*a*, 1005*a*, 1005*b* first end
1111*a*, 1112*a*, 1131*a*, 1205*a*, 1205*b* first end
131*b*, 132*b*, 531*b*, 532*b*, 631*b*, 905*b*, 1131*b* second end
132, 532 second gap
135, 535, 635, 735, 1135 first ground gap
136, 536 second ground gap
509, 609 first auxiliary line
510 second auxiliary line
533, 633 third gap
534 fourth gap
640, 740*a*, 740*b* meander line
641 first line
642 second line
643 third line
650 first opening
715 line
750*a*, 750*b* opening

The invention claimed is:

1. A resonant coupler that wirelessly transmits a signal between a first resonant line and a second resonant line, the resonant coupler comprising:

a first substrate; and a second substrate across from the first substrate, wherein the first substrate includes, on a main surface:

the first resonant line disposed in a circumferential shape and having a first end and a second end;

an input line, into which the signal is inputted, connected to the first resonant line; and a first grounding part that grounds the first end of the first resonant line, the second substrate includes, on a main surface:

the second resonant line disposed in a circumferential shape and having a first end and a second end;

an output line, from which the signal is outputted, connected to the second resonant line; and a second grounding part that grounds the first end of the second resonant line, when viewed in a direction perpendicular to the main surface of the first substrate, the first resonant line and the second resonant line have substantially matching contours, and the first resonant line and the second resonant line have a combined shape that is symmetrical about a line, the first substrate further includes, on the main surface, a first ground line peripheral to the first resonant line, the first grounding part is a line that grounds the first end of the first resonant line by connecting the first end of the first resonant line to the first ground line, the second substrate further includes, on the main surface, a second ground line peripheral to the second resonant line, and the second grounding part is a line that grounds the first end of the second resonant line by connecting the first end of the second resonant line to the second ground line.

2. The resonant coupler according to claim 1, wherein the first ground line is disposed along the first resonant line at a predetermined distance from the first resonant line, and surrounds the first resonant line, and the second ground line is disposed along the second resonant line at a predetermined distance from the second resonant line, and surrounds the second resonant line.

3. The resonant coupler according to claim 2, wherein the first ground line includes, in a portion that surrounds the first resonant line, a first ground gap that opens a portion of the first ground line, and the second ground line includes, in a portion that surrounds the second resonant line, a second ground gap that opens a portion of the second ground line.

4. The resonant coupler according to claim 3, wherein in the portion of the first ground line that surrounds the first resonant line, the first ground gap is located across from a region in which the first end of the first resonant line and the second end of the first resonant line are proximately located, the first ground gap spans a predetermined length that is less than or equal to four line widths of the first ground line, in the portion of the second ground line that surrounds the second resonant line, the second ground gap is located across from a region in which the first end of the second resonant line and the second end of the second resonant line are proximately located, and the second ground gap spans a predetermined length that is less than or equal to four line widths of the second ground line.

5. The resonant coupler according to claim 1, wherein the first substrate further includes a first auxiliary line disposed outside of the contour of the first resonant line and having a first end connected to the second end of the first resonant line, the first auxiliary line has a second end positioned less than or equal to four line widths of the first auxiliary line from the first ground line, the second substrate further includes a second auxiliary line disposed outside the contour of the second resonant line and having a first end connected to the second end of the second resonant line, and the second auxiliary line has a second end positioned less than or equal to four line widths of the second auxiliary line from the second ground line.

6. The resonant coupler according to claim 1, wherein the circumferential shape includes a loop shape, a coil shape, and a bracket shape.

7. The resonant coupler according to claim 1, wherein the first resonant line and the second resonant line have rectangular contours.

8. The resonant coupler according to claim 1, wherein the first substrate and the second substrate are integrated as a single substrate, the main surface of the first substrate is a main surface of the single substrate, and the main surface of the second substrate is a surface of the single substrate opposite the main surface of the single substrate.

9. The resonant coupler according to claim 8, wherein the first end of the first resonant line and the second end of the first resonant line are proximately located, separated by a predetermined distance that is less than or equal to four line widths of the first resonant line, and the first end of the second resonant line and the second end of the second resonant line are proximately located, separated by a predetermined distance that is less than or equal to four line widths of the second resonant line.

10. The resonant coupler according to claim 1, wherein the first resonant line has a line length corresponding to a quarter wavelength of the signal in the first resonant line, and the second resonant line has a line length corresponding to a quarter wavelength of the signal in the second resonant line.

11. The resonant coupler according to claim 1, wherein the first resonant line and the second resonant line are separated in a direction perpendicular to the main surface of the first substrate by a distance within a half wavelength of the signal in the first resonant line.

12. The resonant coupler according to claim 1, wherein the first resonant line and the second resonant line have circular contours.

13. A resonant coupler that wirelessly transmits a signal between a first resonant line and a second resonant line, the resonant coupler comprising:

a first substrate; and a second substrate across from the first substrate, wherein the first substrate includes, on a main surface:

the first resonant line disposed in a circumferential shape and having a first end and a second end;

an input line, into which the signal is inputted, connected to the first resonant line; and a first grounding part that grounds the first end of the first resonant line, the second substrate includes, on a main surface:

the second resonant line disposed in a circumferential shape and having a first end and a second end;

an output line, from which the signal is outputted, connected to the second resonant line; and a second grounding part that grounds the first end of the second resonant line, when viewed in a direction perpendicular to the main surface of the first substrate, the first resonant line and the second resonant line have substantially matching contours, and the first resonant line and the second resonant line have a combined shape that is symmetrical about a line, the first grounding part is a via hole that grounds the first end of the first resonant line, the second grounding part is a via hole that grounds the first end of the second resonant line, the resonant coupler further comprises a third substrate disposed on top of the main surface of the second substrate, the main surface of the first substrate and a surface of the second substrate opposite the main surface of the second substrate are in contact, the first substrate includes, on a surface opposite the main surface, a rear ground line, the third substrate includes, on a surface opposite a surface contacting the second substrate, a third ground line, the first grounding part is a via hole that grounds the first end of the first resonant line by connecting the first end of the first resonant line to the rear ground line, and the second grounding part is a via hole that grounds the first end of the second resonant line by connecting the first end of the second resonant line to the third ground line.

14. A resonant coupler that wirelessly transmits a signal between a first resonant line and a second resonant line, the resonant coupler comprising:

a first substrate; and a second substrate across from the first substrate, wherein the first substrate includes, on a main surface:

the first resonant line disposed in a circumferential shape and having a first end and a second end;

an input line, into which the signal is inputted, connected to the first resonant line; and a first grounding part that grounds the first end of the first resonant line, the second substrate includes, on a main surface:

the second resonant line disposed in a circumferential shape and having a first end and a second end;

an output line, from which the signal is outputted, connected to the second resonant line; and a second grounding part that grounds the first end of the second resonant line, when viewed in a direction perpendicular to the main surface of the first substrate, the first resonant line and the second resonant line have substantially matching contours, and the first resonant line and the second resonant line have a combined shape that is symmetrical about a line, the first end of the first resonant line and the second end of the first resonant line are proximately located, giving the first resonant line a loop shape, the first end of the second resonant line and the second end of the second resonant line are proximately located, giving the second resonant line a loop shape, and the first substrate further includes, on the main surface:

a first opening that opens a portion of the first resonant line; and a first meander line that is disposed within the contour of the first resonant line when viewed in a direction perpendicular to the main surface of the first substrate, and connects two ends of the first resonant line forming the first opening, the second substrate further includes, on the main surface:

a second opening that opens a portion of the second resonant line; and a second meander line that is disposed within the contour of the second resonant line when viewed in a direction perpendicular to the main surface of the second substrate, and connects two ends of the second resonant line forming the second opening, and when viewed in a direction perpendicular to the main surface of the first substrate, a shape of the first resonant line and the first meander line and a shape of the second resonant line and the second meander line have a combined shape that is symmetrical about a line.

15. The resonant coupler according to claim 14, wherein the first meander line includes:

a first line disposed in a straight line shape and having a first end connected to a first of the two ends forming the first opening;

a second line disposed in a straight line shape and having a first end connected to a second of the two ends forming the first opening; and a third line disposed in a straight line shape and having a first end connected to a second end of the first line and a second end connected to a second end of the second line, and the second meander line includes:

a fourth line disposed in a straight line shape and having a first end connected to a first of the two ends forming the second opening;

a fifth line disposed in a straight line shape and having a first end connected to a second of the two ends forming the second opening; and a sixth line disposed in a straight line shape and having a first end connected to a second end of the fourth line and a second end connected to a second end of the fifth line.

16. The resonant coupler according to claim 14, wherein the first substrate includes, on the main surface, a region in which the first resonant line and the first meander line are proximately located, separated by less than or equal to four line widths of the first resonant line or less than or equal to four line widths of the first meander line, and the second substrate includes, on the main surface, a region in which the second resonant line and the second meander line are proximately located, separated by less than or equal to four line widths of the second resonant line or less than or equal to four line widths of the second meander line.

* * * * *